US010406596B2

(12) United States Patent
Gleiner et al.

(10) Patent No.: US 10,406,596 B2
(45) Date of Patent: Sep. 10, 2019

(54) CORE ARRANGEMENT FOR TURBINE ENGINE COMPONENT

(71) Applicant: United Technologies Corporation, Hartford, CT (US)

(72) Inventors: Matthew S. Gleiner, Norwalk, CT (US); Bret M. Teller, Meriden, CT (US); James T. Auxier, Bloomfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 382 days.

(21) Appl. No.: 14/702,136

(22) Filed: May 1, 2015

(65) Prior Publication Data

US 2016/0319674 A1 Nov. 3, 2016

(51) Int. Cl.
*F01D 5/14* (2006.01)
*F01D 5/18* (2006.01)
(Continued)

(52) U.S. Cl.
CPC ..... *B22C 9/101* (2013.01); *B22C 9/06* (2013.01); *B22C 9/103* (2013.01); *B22D 15/00* (2013.01);
(Continued)

(58) Field of Classification Search
CPC ..... B22D 15/00
See application file for complete search history.

(56) References Cited

U.S. PATENT DOCUMENTS 4,627,480 A * 12/1986 Lee ..... B22C 9/04 164/122.1
5,052,889 A * 10/1991 Abdel-Messeh ..... F01D 5/187 165/170
(Continued)

FOREIGN PATENT DOCUMENTS

EP 0758932 2/1997
EP 1543896 6/2005
(Continued)

OTHER PUBLICATIONS

Singapore Search Report and Written Opinion for Singapore Patent Application No. 10201602096Y completed Aug. 8, 2016.
(Continued)

*Primary Examiner* — Dwayne J White
*Assistant Examiner* — Jason G Davis
(74) *Attorney, Agent, or Firm* — Carlson, Gaskey & Olds, P.C.

(57) ABSTRACT

A casting core for an airfoil according to an example of the present disclosure includes, among other things, a first portion extending in a first direction and corresponding to a first cavity of an airfoil. The first portion defines a reference plane along a parting line formed by a casting die. The first portion defines a plurality of grooves corresponding to a plurality of trip strips of the airfoil. Each of the plurality of grooves defines a respective groove axis, and the plurality of grooves are distributed in the first direction along a first side of the reference plane such that one or more of the groove axes are oriented with respect to a pull direction of the casting die. A method for fabricating a gas turbine engine component is also disclosed.

11 Claims, 7 Drawing Sheets

(51) Int. Cl.

| | |
|---|---|
| ***B22C 9/10*** | (2006.01) |
| ***B22D 15/00*** | (2006.01) |
| ***B22D 17/00*** | (2006.01) |
| ***B22C 9/06*** | (2006.01) |
| ***B22D 25/02*** | (2006.01) |
| ***F01D 5/02*** | (2006.01) |
| ***F01D 9/04*** | (2006.01) |
| ***F01D 11/08*** | (2006.01) |
| ***F01D 25/12*** | (2006.01) |

(52) U.S. Cl.

CPC ..... *B22D 17/00* (2013.01); *B22D 25/02* (2013.01); *F01D 5/02* (2013.01); *F01D 5/14* (2013.01); *F01D 5/147* (2013.01); *F01D 5/187* (2013.01); *F01D 9/041* (2013.01); *F01D 11/08* (2013.01); *F01D 25/12* (2013.01); *F05D 2220/32* (2013.01); *F05D 2230/21* (2013.01); *F05D 2230/211* (2013.01); *F05D 2260/202* (2013.01)

(56) References Cited

U.S. PATENT DOCUMENTS

| | | | | |
|---|---|---|---|---|
| 5,232,343 | A | 8/1993 | Butts | |
| 5,395,212 | A * | 3/1995 | Anzai | F01D 5/187 415/115 |
| 5,431,537 | A | 7/1995 | Sturm | |
| 5,472,316 | A | 12/1995 | Taslim et al. | |
| 6,068,445 | A | 5/2000 | Beeck et al. | |
| 6,340,047 | B1 * | 1/2002 | Frey | B22C 21/14 164/122.1 |
| 7,216,689 | B2 * | 5/2007 | Verner | B22C 7/02 164/45 |
| 8,083,485 | B2 * | 12/2011 | Chon | F01D 5/187 416/97 R |
| 8,376,706 | B2 | 2/2013 | Bunker et al. | |
| 8,757,974 | B2 | 6/2014 | Propheter-Hinckley et al. | |
| 8,961,133 | B2 | 2/2015 | Kwon | |
| 2004/0208744 | A1 | 10/2004 | Shi et al. | |
| 2007/0297916 | A1 | 12/2007 | Levine et al. | |
| 2010/0303635 | A1 * | 12/2010 | Townes | F01D 5/187 416/97 R |
| 2015/0003999 | A1 | 1/2015 | Campbell, Jr. et al. | |
| 2015/0044029 | A1 | 2/2015 | Tibbott et al. | |

FOREIGN PATENT DOCUMENTS

| | | |
|---|---|---|
| WO | 20140159589 | 10/2014 |
| WO | 2015023338 | 2/2015 |

OTHER PUBLICATIONS

European Search Report for European Patent Application No. 16167665 completed Sep. 22, 2016.

* cited by examiner

CORE ARRANGEMENT FOR TURBINE ENGINE COMPONENT

BACKGROUND

This disclosure relates to cooling for a component of a gas turbine engine.

Gas turbine engines can include a fan for propulsion air and to cool components. The fan also delivers air into a core engine where it is compressed. The compressed air is then delivered into a combustion section, where it is mixed with fuel and ignited. The combustion gas expands downstream over and drives turbine blades. Static vanes are positioned adjacent to the turbine blades to control the flow of the products of combustion. The blades and vanes are subject to extreme heat, and thus cooling schemes are utilized for each.

SUMMARY

A casting core for an airfoil according to an example of the present disclosure includes a first portion extending in a first direction and corresponding to a first cavity of an airfoil. The first portion defines a reference plane along a parting line formed by a casting die. The first portion defines a plurality of grooves corresponding to a plurality of trip strips of the airfoil. Each of the plurality of grooves defines a respective groove axis, and the plurality of grooves are distributed in the first direction along a first side of the reference plane such that one or more of the groove axes are oriented with respect to a pull direction of the casting die.

In a further embodiment of any of the foregoing embodiments, one or more of the groove axes is parallel to the pull direction.

In a further embodiment of any of the foregoing embodiments, at least some grooves of the plurality of grooves extend a length along the groove axis such that the at least some grooves are substantially straight.

In a further embodiment of any of the foregoing embodiments, the groove axis of each of the plurality of grooves is arranged at a radial angle relative to the reference plane such that the radial angle of each of the first set of grooves is the same in the first direction.

In a further embodiment of any of the foregoing embodiments, the plurality of grooves includes a first set of grooves oriented with respect to the pull direction and a second set of grooves. The second set of grooves corresponds to a second set of trip strips of the airfoil, and the second set of grooves are distributed in the first direction such that each of the second set of grooves defines a respective second groove axis transverse to the pull direction of the casting die.

In a further embodiment of any of the foregoing embodiments, at least some grooves of the second set of grooves extend from at least some grooves of the first set of grooves.

A further embodiment of any of the foregoing embodiments includes a second portion extending in the first direction and corresponding to a feeding cavity of the airfoil. The second portion is defined by the casting die. The first cavity is an impingement cavity located at a leading edge of the airfoil and in communication with the feeding cavity.

In a further embodiment of any of the foregoing embodiments, the parting line is curvilinear.

A gas turbine engine according to an example of the present disclosure includes a rotor and a vane spaced axially from said rotor. A blade outer air seal is spaced radially from the rotor. At least one of the rotor and the vane includes an airfoil section extending from a platform. At least one of the airfoil section, the platform, and the blade outer air seal includes a first cavity extending in a first direction. The first cavity defines a reference plane along a parting line formed by a casting die. A first set of trip strips are distributed in the first direction along a surface of the first cavity and on a first side of the reference plane. Each of the first set of trip strips defines a respective groove axis. The groove axes are oriented with respect to a pull direction of the casting die.

In a further embodiment of any of the foregoing embodiments, the first cavity is an impingement cavity bounded by an external wall of the airfoil section.

In a further embodiment of any of the foregoing embodiments, the external wall defines a leading edge of the airfoil section.

In a further embodiment of any of the foregoing embodiments, the platform section defines at least one of the first set of trip strips.

In a further embodiment of any of the foregoing embodiments, one or more of the groove axes of the first set of trip strips is parallel to the pull direction.

A further embodiment of any of the foregoing embodiments includes a second set of trip strips distributed in the first direction along surfaces of the first cavity such that each of the second set of trip strips defines a respective second axis transverse to the pull direction.

In a further embodiment of any of the foregoing embodiments, at least some trip strips of the second set of trip strips are connected to at least one trip strip of the first set of trip strips.

A method for fabricating a gas turbine engine component according to an example of the present disclosure includes arranging a first die half adjacent to a second die half to define a parting line forming a first portion between the first die half and the second die half. The parting line extends in a first direction along the first portion, and the first portion corresponds to a first cavity of an airfoil. The first portion defines a first set of grooves corresponding to first set of trip strips of the airfoil. Each of the first set of grooves defines a respective groove axis, and the first set of grooves are distributed in the first direction such that one or more of the groove axes is oriented with respect to a pull direction of at least one of the first die half and the second die half.

A further embodiment of any of the foregoing embodiments includes removing material from the first portion along the parting line, and wherein the first cavity is an impingement cavity located at a leading edge of the airfoil.

In a further embodiment of any of the foregoing embodiments, one or more of the groove axes is parallel to the pull direction.

In a further embodiment of any of the foregoing embodiments, at least some grooves of the first set of grooves are substantially straight along the groove axis.

In a further embodiment of any of the foregoing embodiments, the first portion defines a second set of grooves corresponding to a second set of trip strips of the airfoil. The second set of grooves are distributed such that each of the second set of grooves defines a respective second groove axis transverse to the pull direction of the at least one of the first die half and the second die half, and at least some grooves of the second set of grooves are connected to at least some grooves of the first set of grooves.

Although the different examples have the specific components shown in the illustrations, embodiments of this disclosure are not limited to those particular combinations. It is possible to use some of the components or features from one of the examples in combination with features or components from another one of the examples.

The various features and advantages of this invention will become apparent to those skilled in the art from the following detailed description of an embodiment. The drawings that accompany the detailed description can be briefly described as follows.

DETAILED DESCRIPTION

Figure 1:
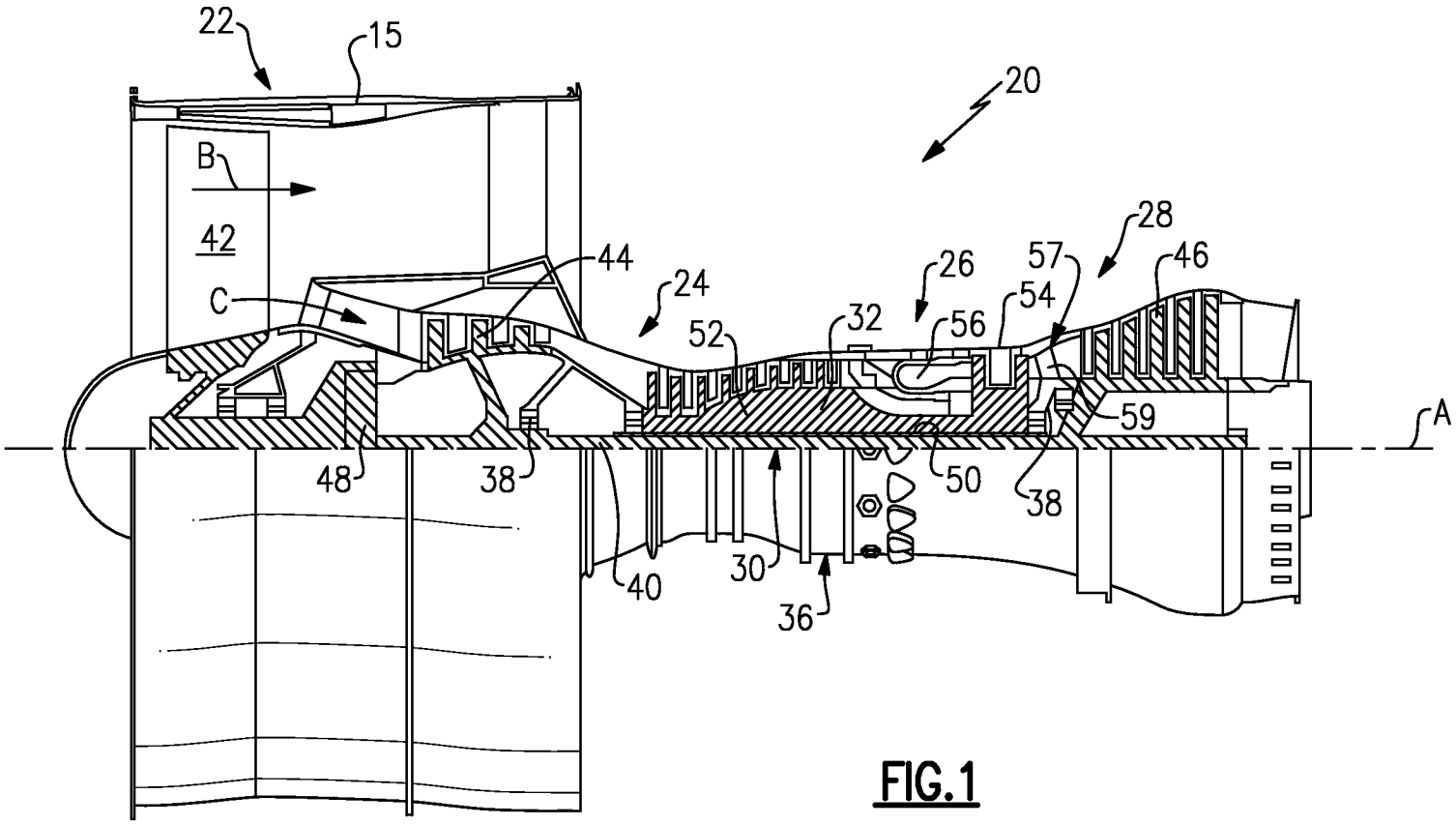
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (or 10,668 meters). The flight condition of 0.8 Mach and 35,000 ft (or 10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (or about 351 meters/second).

Figure 2:
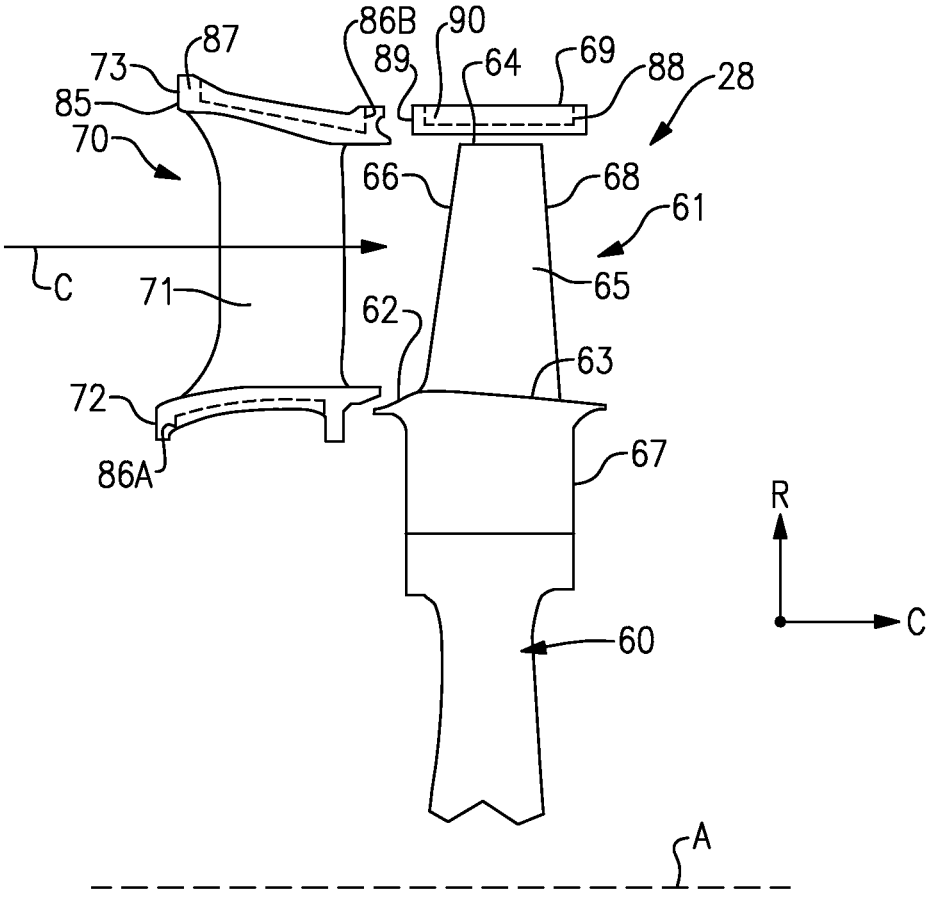
FIG. 2 schematically shows an airfoil arrangement for a turbine section.

FIG. 2 shows selected portions of the turbine section 28 including a rotor 60 carrying one or more airfoils or blades 61 for rotation about the central axis A. In this disclosure, like reference numerals designate like elements where appropriate and reference numerals with the addition of one-hundred or multiples thereof designate modified elements that are understood to incorporate the same features and benefits of the corresponding original elements.

In this example, each blade 61 includes a platform 62 and an airfoil section 65 extending in a radial direction R from the platform 62 to a tip 64. The airfoil section 65 generally extends in a chordwise direction C between a leading edge 66 and a trailing edge 68. A root section 67 of the blade 61 is mounted to the rotor 60, for example. It should be understood that the blade 61 can alternatively be integrally formed with the rotor 60, which is sometimes referred to as an integrally bladed rotor (IBR). A blade outer air seal (BOAS) 69 is spaced radially outward from the tip 64 of the airfoil section 65. A vane 70 is positioned along the engine axis A and adjacent to the blade 61. The vane 70 includes an airfoil section 71 extending between an inner platform 72 and an outer platform 73 to define a portion of the core flow path C. The turbine section 28 includes multiple blades 61, vanes 70, and blade outer air seals 69 arranged circumferentially about the engine axis A.

Figure 3A:
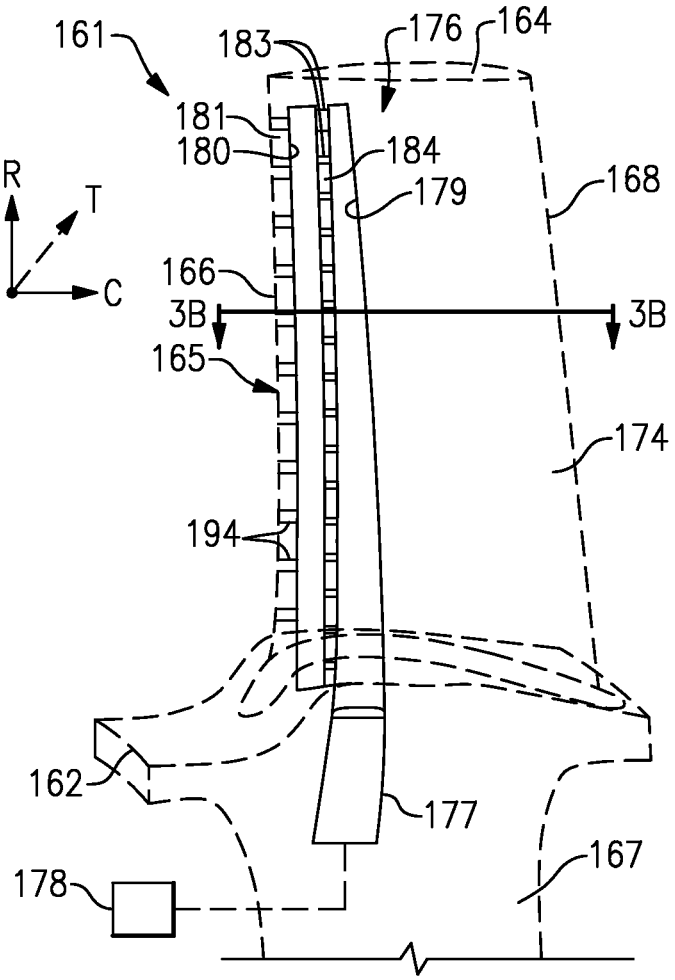
FIG. 3A illustrates a side view of a cooling arrangement with an airfoil shown in phantom.
Figure 3B:
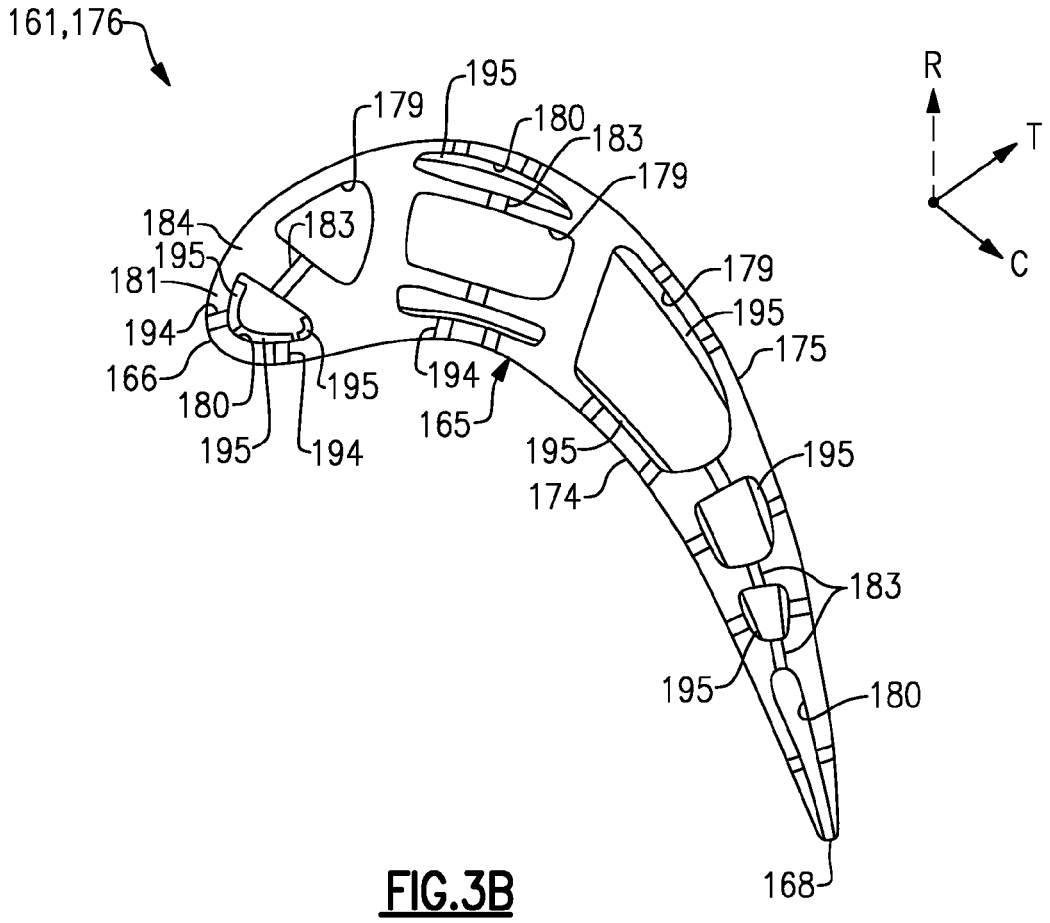
FIG. 3B illustrates a cross-sectional view of the cooling arrangement along line 3B-3B of FIG. 3A.

FIGS. 3A and 3B illustrate an exemplary cooling arrangement 176 for a blade 161, such as the one or more blades 61 of FIG. 2. Although the exemplary cooling arrangements discussed in the disclosure primarily refer to a turbine blade, the teachings herein can also be utilized for another portion of the engine 20 such as vane 70 or BOAS 69, for example.

At least one radial cooling passage 177 (only one shown for illustrative purposes) is provided between pressure and suction sides 174, 175 in a thickness direction T which is generally perpendicular to a chordwise direction C. Each radial cooling passage 177 extends from a root section 167 through the platform 162 and toward the tip 164 to communicate coolant to various portions of the blade 161. Each radial passage 177 is configured to receive coolant from a coolant source 178 (shown schematically). Coolant sources 178 can include bleed air from an upstream stage of the compressor section 24, bypass air, or a secondary cooling system aboard the aircraft, for example.

The cooling arrangement 176 includes a feeding cavity 179 (or one of a first cavity and a second cavity) and an impingement cavity 180 (or the other one of the first cavity and the second cavity) coupled by one or more crossover passages 183 within an internal wall 184 (only one feeding cavity 179 and one impingement cavity 180 shown in FIG. 3A for illustrative purposes). One of the radial passages 177 or another source communicates coolant to the feeding cavity 179.

The feeding cavity 179 and impingement cavity 180 can be formed in various locations of the blade 161. In some examples, the impingement cavity 180 is bounded by an external wall 181 of the blade 161. As shown, the feeding cavity 179 and/or impingement cavity 180 are located at the leading edge 166. In another example, the feeding cavity 179 and/or the impingement cavity 180 are located at the trailing edge 168 or between the leading and trailing edges 166, 168 (shown in FIG. 3B). The airfoil section 165 can include multiple feeding cavities 179 and/or impingement cavities 180 to provide cooling to various portions of the airfoil section 165, as illustrated in FIG. 3B. The blade 161 can include one or more film cooling holes or passages 194 in fluid communication with one or more of the feeding cavity 179 and/or the impingement cavity 180 to provide film cooling to various surfaces of the blade 161.

The cooling arrangement 176 includes one or more trip strips 195 (shown in FIG. 3B) extending from a wall of the feeding cavity 179 and/or the impingement cavity 180. The trip strips 195 are arranged to interact with coolant communicated in the cavities 179, 180 to provide convective cooling to adjacent portions of the blade 161. The trip strips 195 can be arranged at various locations depending on the needs of a particular situation, and arranged at various orientations utilizing any of the techniques discussed herein.

Figure 4A:
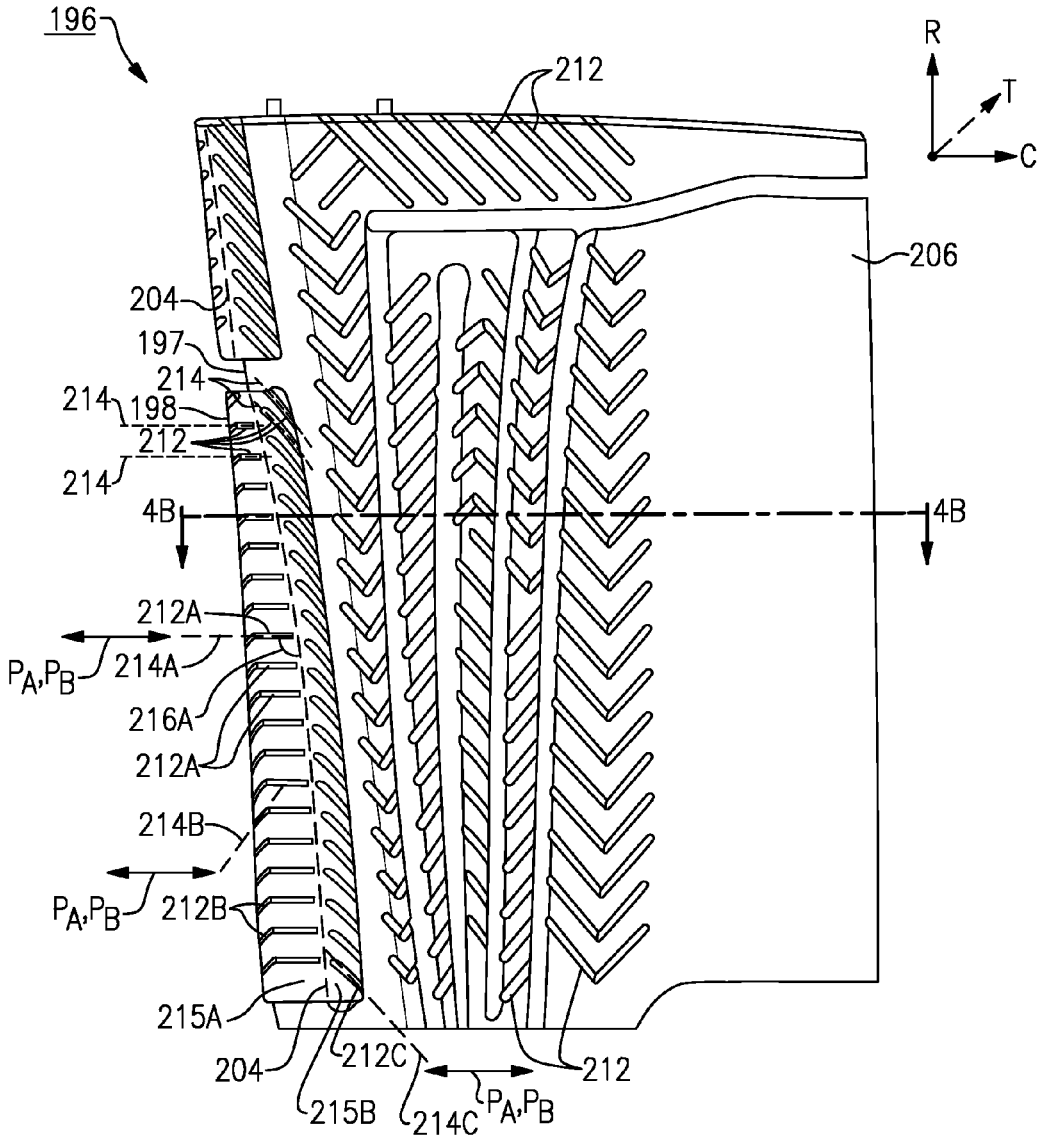
FIG. 4A illustrates a perspective view of a casting core corresponding to a cooling arrangement.
Figure 4B:
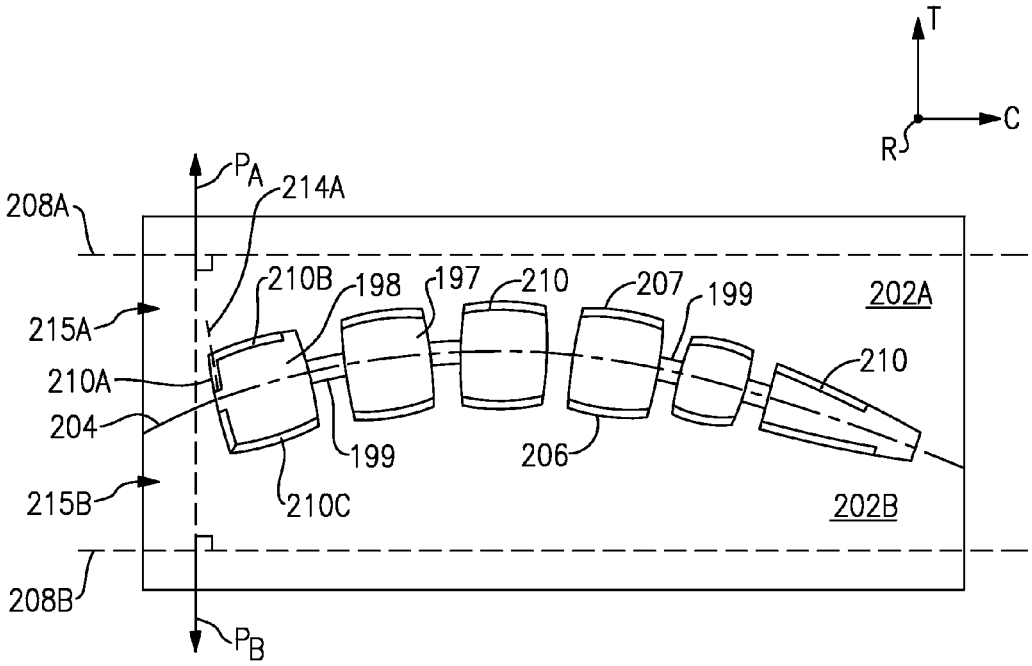
FIG. 4B illustrates a cross-sectional view of the casting core along line 4B-4B of FIG. 4A.

FIGS. 4A and 4B illustrate a portion of a casting core 196 having various arrangements corresponding to various feeding and impingement cavities 179, 180 of the cooling arrangement 176, for example. The casting core 196 includes a first portion 197 corresponding to the feeding cavity 179 and a second portion 198 corresponding to the impingement cavity 180, for example. In other examples, the first portion 197 corresponds to the impingement cavity 180, and the second portion 198 corresponds to the feeding cavity 179. In the illustrative example, the casting core 196 is provided with one or more crossover connectors 199 (shown in FIG. 4B), which correspond to crossover passages, to connect the first portion 197 and the second portion 198.

Portions of the casting core 196 can be fabricated by at least two complementary casting dies 202A, 202B (shown in FIG. 4B) utilizing various casting techniques, for example. Although only two casting dies 202 are shown, more than two casting dies can be utilized to form various portions of the casting core 196 including any of the groove arrangements discussed herein. The casting dies 202A, 202B form, or otherwise define, one or more parting lines 204 at locations of the casting core 196 where the casting dies 202A, 202B abut each other. In some examples, the parting line 204 defines a reference plane extending generally in the radial and chordwise directions C, R to separate a pressure side 206 and a suction side 207 of the casting core 196. The parting line 204 or reference plane can be planar or curvilinear, for example. Casting die 202A defines a pull direction $P_A$ perpendicular to a corresponding pull plane $\mathbf{208}_A$, and casting die 202B can define a pull direction $P_B$ perpendicular to a corresponding pull plane $\mathbf{208}_B$ (shown in FIG. 4B).

Surface protrusions 210 extending from one or more cavities of the casting dies 202A, 202B are configured such that one or more grooves 212 (shown in FIG. 4A) corresponding to trip strips 195 are defined in the first portion 197 and/or the second portion 198. As shown, at least some of the grooves 212 are spaced from the parting line 204 to permit removal of material or flash from the casting core 196 at a predetermined keep-out area adjacent the parting line 204.

The grooves 212 can be arranged relative to the reference plane defined by the parting line 204. Each of the grooves 212 defines a respective groove axis 214 (shown in FIG. 4A and also indicated at FIG. 4B for corresponding surface protrusions 210A). As shown, a first set of grooves 212A are distributed along a first side 215A (shown in FIG. 4B) of the reference plane defined by parting line 204 such that one or more of the groove axes 214A of the first set of grooves 212A is oriented with respect to a pull direction P of at least one of the casting dies 202A, 202B. In further examples, one or more, or each, of the groove axes 214A of the first set of grooves 212A is parallel to the pull direction P of at least one of the casting dies 202A, 202B, and in yet further examples, one or more, or each, of the groove axes 214A is substantially horizontal or parallel to a reference plane extending in the thickness and chordwise directions T, C. Parallel can be within ±10 degrees, more narrowly within ±5 degrees, or evenly more narrowly exactly parallel. The first side 215A can correspond to the pressure side 174 and a second side 215B can correspond to the suction side 175 of the blade 161, for example.

The arrangement of the first set of grooves 212A relative to the parting line 204 reduces a likelihood of backlock of the casting core 196 during separation of the casting dies 202A, 202B, and also reduces the need for additional die pulls and parting lines during formation of the grooves 212, thereby simplifying the fabrication of the casting core 196. The arrangement of the first set of grooves 212A can reduce the keep-out areas adjacent the parting line 204, thereby allowing a relatively greater length and improved convective cooling characteristics.

Other arrangements of the grooves 212A can be utilized. In some examples, the groove axis 214A of each of the first set of grooves 212A is parallel to the pull direction P. In other examples, the groove axis 214A of each of the first set of grooves 212A is arranged at a radial angle 216A relative to a localized region of the reference plane defined by the parting line 204 an orientation of the each of the first set of grooves 212A is substantially the same in the spanwise or radial direction R (or first direction). As shown in FIG. 4A, at least some of the first set of grooves 212A extend a length along the groove axis 214A such that the at least some grooves 212A are substantially straight and are aligned in the pull direction P. In further examples, the first set of grooves 212A are substantially aligned in parallel with a plane extending in the chordwise and thickness directions C, T as illustrated in FIG. 4A. In alternative examples, the first set of grooves 212A can be located on a second side 215B of the reference plane defined by the parting line 204 such that the corresponding trip strips 195 are located adjacent to the pressure side 174 of the blade 161, for example.

The casting dies 202 can define other grooves 212 in various locations of the casting core 196. In some examples, surface protrusions 210B of the casting dies 202 such as casting die 202A are configured to define a second set of grooves 212B distributed in the spanwise or radial direction R (or first direction) such that each of the second set of grooves 212B defines a second respective groove axis 214B (also indicated at FIG. 4B for corresponding surface protrusions 210B) transverse to the pull direction P of at least one of the casting dies 202A, 202B. The transverse arrangement of the second set of grooves 212B allows for a greater length and convective cooling characteristics relative to the first set of grooves 212A. As shown, one or more of the second set of grooves 212B can be connected to one or more of the first set of grooves 212A to increase an overall wetted area and convective cooling characteristics of the corresponding trip strips 195.

Surface protrusions 210C of the casting dies 202, such as casting die 202B, can be configured to define a third set of grooves 212C distributed on the second side 215B (shown in FIG. 4B) of the reference plane defined by the parting line 204. As shown, the third set of grooves 212C can be arranged such that the groove axis 214C of at least some of third set of grooves 212C is transverse to the pull direction P. In alternative embodiments, the third set of grooves 212C can be arranged in a similar manner as the first set of grooves 212A such that the groove axis 214C of at least some of the third set of grooves 212C is oriented with respect to a pull direction P, or parallel to, at least one of the casting dies 202A, 202B.

Although the grooves 212, corresponding trip strips 195, and casting dies 202 are primarily discussed with respect to a leading edge 166 of a blade 161, the various arrangements of the grooves 212 and trip strips 195 can be utilized at other locations of the in the airfoil section 165 and/or the platform 162 of the blade 161 and other locations of the engine 20, utilizing any of the techniques discussed herein.

Figure 5A:
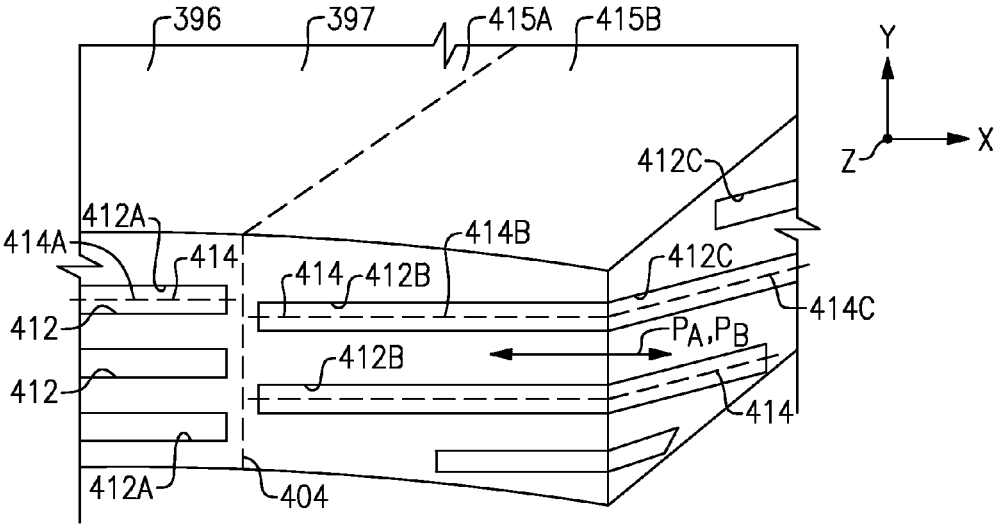
FIG. 5A illustrates a perspective view of a second embodiment of a casting core corresponding to a cooling arrangement for a component.
Figure 5B:
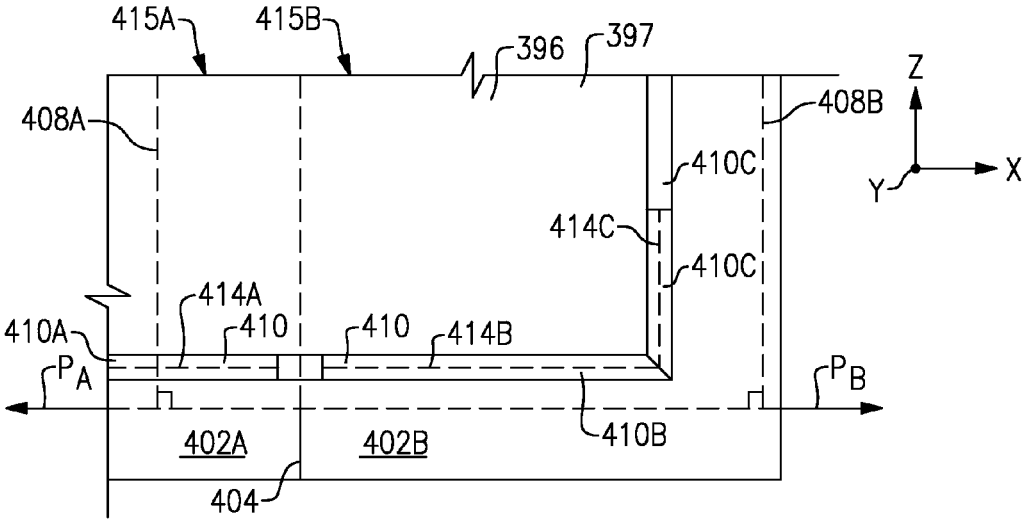
FIG. 5B illustrates a cross-sectional view of the casting core of FIG. 5A.

FIGS. 5A and 5B illustrates a second embodiment of portions of a casting core 396 for a component. The casting core 396 can be utilized in the formation of cooling arrangements for components of the engine 20 such as one of the platforms 62, 72, 73 or the BOAS 69 of FIG. 2, for example. Although the casting core 396 is shown having a generally rectangular profile, which can be contoured with respect to the engine axis A (shown in FIGS. 1 and 2), for example, other configurations can be utilized depending on the needs of a particular situation in view of the teachings herein.

The casting core 396 includes at least a first portion 397 corresponding to an impingement cavity or a feeding cavity having various arrangements. Portions of the casting core 396 can be fabricated by at least two complementary casting dies 402A, 402B (shown in FIG. 5B) utilizing any of various casting techniques and arrangements disclosed herein. The casting dies 402A, 402B form, or otherwise define, one or more parting lines 404. Casting die 402A defines a pull direction $P_A$ perpendicular to a corresponding pull plane $\mathbf{408}_A$, and casting die 402B can define a pull direction $P_B$ perpendicular to a corresponding pull plane $\mathbf{408}_B$ (shown in FIG. 5B). One or more surface protrusions 410 extend from one or more cavities of the casting dies 402A, 402B and are configured such that one or more grooves 412 are formed in the casting core 396 (shown in FIG. 5A) which correspond to one or more trip strips in the component. At least some of the grooves 412 are spaced from the parting line 404.

The grooves 412 can be arranged relative to the reference plane defined by the parting line 404 utilizing any of the techniques described herein. As shown, a first set of grooves 412A are distributed along a first side 415A of a reference plane defined by the parting line 404 such that one or more of the groove axes 414A of the first set of grooves 412A is oriented with respect to a pull direction P of at least one of the casting dies 402A, 402B. A second set of grooves 412B are distributed along a second side 415B of the reference plane defined by the parting line 404 such that one or more of groove axes 414B of the second set of grooves 412B is oriented with respect to a pull direction P of at least one of the casting dies 402A, 402B. In the illustrative example, the groove axis 414 of at least some of the first and/or second set of grooves 412A, 412B is parallel to the pull direction P of at least one of the casting dies 402A, 402B. A third set of grooves 412C are distributed along the second side 415B such that the one or more of the groove axes 414C of the third set of grooves 412C is oriented transverse to the pull direction P, and can be connected to one or more of the second set of grooves 412B.

In some examples, the core 396 is a wax core formed by dies utilizing the techniques discussed herein, which can be utilized to form one or more pockets 86A, 86B at various locations and orientations in platform 70 or pockets 88 at various locations and orientations in BOAS 69 of FIG. 2. The pockets 86A, 86B or 88 can be arranged opposite of the core flow path C and can be configured to receive coolant from various cooling sources including those discussed herein to provide impingement cooling to selected portions of the platform 70 or BOAS 69, for example. In one example, grooves 412A, 412B are located adjacent to a leading edge 85 of one of the platforms 72, 73 of vane 70, and grooves 412C are located adjacent to a mate face 87 of one of the platforms 72, 73 (shown in FIG. 2). In another example, the grooves 412A, 412B are located adjacent to a leading edge 89 of BOAS 69 and grooves 412C are located adjacent to a mate face 90 of BOAS 69 (shown in FIG. 2).

Although particular step sequences are shown, described, and claimed, it should be understood that steps may be performed in any order, separated or combined unless otherwise indicated and will still benefit from the present disclosure.

It should be understood that relative positional terms such as "forward," "aft," "upper," "lower," "above," "below," and the like are with reference to the normal operational attitude of the vehicle and should not be considered otherwise limiting.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A casting core for an airfoil, comprising:

a first portion extending in a first direction and corresponding to a first cavity of an airfoil, the first portion defining a reference plane along a parting line formed by a casting die;

the first portion defines a plurality of grooves corresponding to a plurality of trip strips of the airfoil, each of the plurality of grooves defines a respective groove axis, and the plurality of grooves are distributed in the first direction along a first side of the reference plane such that one or more of the groove axes are oriented with respect to a pull direction of the casting die; and wherein the plurality of grooves includes a first set of grooves that extend a length along the respective groove axis such that the first set of grooves are substantially straight, the respective groove axis of each of the first set of grooves is parallel to the pull direction, and the groove axis of each of the plurality of grooves extends longitudinally between a first end and an opposed, second end of the respective groove of the plurality of grooves.

2. The casting core for an airfoil as recited in claim 1, wherein the groove axis of each of the plurality of grooves is arranged at a radial angle relative to the reference plane such that the radial angle of each of the first set of grooves is the same in the first direction.

3. The casting core for an airfoil as recited in claim 1, wherein the plurality of grooves includes the first set of grooves oriented with respect to the pull direction and a second set of grooves, the second set of grooves corresponding to a second set of trip strips of the airfoil, and the second set of grooves are distributed in the first direction such that each groove axis of the respective second set of grooves is transverse to the pull direction of the casting die.

4. The casting core for an airfoil as recited in claim 3, wherein at least some grooves of the second set of grooves extend from at least some grooves of the first set of grooves.

5. The casting core for an airfoil as recited in claim 4, wherein the groove axis of each of the second set of grooves is arranged at a radial angle relative to the reference plane such that the groove axis has a component that extends in the first direction, the first direction corresponding to a radial direction of the airfoil, and the airfoil including an airfoil body extending in the radial direction from a platform and extending in a thickness direction between a pressure side and a suction side, with the reference plane extending in the radial direction and extending in an axial direction between a leading edge and a trailing edge of the airfoil body.

6. The casting core for an airfoil as recited in claim 1, comprising:

a second portion extending in the first direction and corresponding to a feeding cavity of the airfoil, the second portion defined by the casting die; and wherein the first cavity is an impingement cavity located at a leading edge of the airfoil and in communication with the feeding cavity.

7. The casting core for an airfoil as recited in claim 1, wherein the parting line is curvilinear.

8. The casting core for an airfoil as recited in claim 1, wherein the plurality of grooves are spaced apart from the parting line.

9. The casting core for an airfoil as recited in claim 8, comprising:

a second portion extending in the first direction and corresponding to a feeding cavity of the airfoil, the second portion defined by the casting die; and wherein the first cavity is an impingement cavity located at a trailing edge of the airfoil and in communication with the feeding cavity.

10. The casting core for an airfoil as recited in claim 8, wherein the first side corresponds to one of a pressure side and a suction side of the airfoil, and the reference plane defines a second side opposite the first side that corresponds to another one of the pressure side and the suction side, with the reference plane extending in a radial direction with respect to the airfoil to separate the pressure side and the suction side.

11. The casting core for an airfoil as recited in claim 10, wherein the casting die is a first casting die, and further comprising a second casting die, the first portion arranged between the first casting die and the second casting die that abuts against the first casting die to form the parting line.

* * * * *